US007004314B2

(12) United States Patent
Pucillo et al.

(10) Patent No.: US 7,004,314 B2
(45) Date of Patent: Feb. 28, 2006

(54) MULTI-PRODUCT CONTAINER

(75) Inventors: Robert J. Pucillo, Gilberts, IL (US); Alex D. Bevier, Naches, WA (US)

(73) Assignee: Weyerhaeuser Company, Federal Way, WA (US)

( * ) Notice: Subject to any disclaimer, the term of this patent is extended or adjusted under 35 U.S.C. 154(b) by 293 days.

(21) Appl. No.: 10/435,404

(22) Filed: May 9, 2003

(65) Prior Publication Data

US 2004/0222109 A1 Nov. 11, 2004

(51) Int. Cl.
*B65D 77/00* (2006.01)
*B65D 5/20* (2006.01)
*B65D 25/04* (2006.01)

(52) U.S. Cl. ..... 206/217; 206/562; 206/763; 229/120.13; 229/120.08

(58) Field of Classification Search ..... 206/217, 206/541, 562, 563, 763, 765; 229/120.08, 229/120.13, 902, 904
See application file for complete search history.

(56) References Cited

U.S. PATENT DOCUMENTS 1,448,864 A * 3/1923 Pinkerton ..... 229/120.08
2,330,345 A * 9/1943 Elliott ..... 229/120.08
2,335,366 A * 11/1943 Stearn ..... 229/120.08
2,833,458 A * 5/1958 Toensmeier ..... 206/562
3,189,247 A * 6/1965 Wischusen ..... 206/563
5,890,648 A * 4/1999 Cai ..... 229/904
6,213,389 B1 * 4/2001 Cai ..... 229/904
6,568,586 B1 * 5/2003 VanEsley et al. ..... 206/562
2004/0200891 A1 * 10/2004 Correll ..... 229/904

* cited by examiner

*Primary Examiner*—Jila M. Mohandesi

(57) ABSTRACT

The present invention is directed to a multi-product container and container blank. In accordance with the present invention, a single sheet of foldable material is cut and scored to define a container blank. The blank includes a bottom panel, a front panel, a back panel, opposed side panels and a plurality of corner panels. Also, a top panel is attached to the back panel opposite said bottom panel. A fold over divider panel assembly that includes a cup panel attached to the front panel opposite said bottom panel and a divider panel attached to said cup panel opposite said front panel. A cup receptacle formed in said cup panel. The divider panel includes a divider panel slot positioned opposite the cup panel. Also, a side panel slot is formed in each of the side panels at a location opposite the bottom panel. As formed, the front panel, back panel opposed side panels and plurality of corner panels are hingedly attached to said bottom panel via unperforated score lines.

10 Claims, 7 Drawing Sheets

MULTI-PRODUCT CONTAINER

FIELD OF THE INVENTION

This invention relates generally to containers and, more specifically, to multi-product containers.

BACKGROUND OF THE INVENTION

Multi-product containers are known in the art. They are typically used to ship or contain related products. For example, in the food industry, the various products may be pieces of chicken or other meats combined with containers for sauce or other seasoning material. Containers of this style typically have one container region for a first product and another container region for a second product.

There are several problems with the current designs. Initially, the current designs are overly complex to manufacture, are not structurally sound, or both. Also, the current designs typically are not leak or sift proof and therefore are limited in application. Finally, the current designs typically do not have top panels that cover all of the regions containing product. As such, the current design applications are limited by the container's failure to provide a sanitary barrier over all of the products within the container.

SUMMARY OF THE INVENTION

The present invention is directed to a multi-product container and container blank. In accordance with the present invention, a single sheet of foldable material is cut and scored to define a container blank. The blank includes a bottom panel, a front panel, a back panel, opposed side panels and a plurality of corner panels. Also, a top panel is attached to the back panel opposite said bottom panel. A fold over divider panel assembly that includes a cup panel that is attached to the front panel opposite the bottom panel and a divider panel attached to the cup panel opposite said front panel. A cup receptacle is formed in the cup panel. The divider panel includes a divider panel slot positioned opposite the cup panel. Also, a side panel slot is formed in each of the side panels at a location opposite the bottom panel. As formed, the front panel, back panel opposed side panels and plurality of corner panels are hingedly attached to said bottom panel via unperforated score lines.

The present invention further includes a container having a bottom panel with opposed front and back panels and opposed side panels. A top panel is attached to said back panel opposite said bottom panel. A side panel slot is formed in each of said side panels at a location opposite of the bottom panel. A fold over divider assembly having a cup panel attached to the front panel and a divider panel attached to the cup panel opposite of the front panel. A cup is formed in said cup panel. The divider panel includes at least two divider panel slots formed opposite said cup panel. As formed, the divider panel lies in a plane substantially parallel to the front panel and intersects the side panels at the side panel slots such that the divider panel slots and the side panel slots engage each other.

BRIEF DESCRIPTION OF THE DRAWINGS

The preferred and alternative embodiments of the present invention are described in detail below with reference to the following drawings.

DETAILED DESCRIPTION OF THE INVENTION

The present invention will now be described with reference to the accompanying drawings. The present invention is directed to a multi-product type container that utilizes a fold over divider panel assembly including a cup panel with cups and a divider panel to create a divided container. One suitable embodiment of a multi-product type container 51*a, b*, constructed in accordance with aspects of the present invention is illustrated in FIGS. 1–5. Further attributes of the present invention are illustrated in FIGS. 6–9. Specific details of the blank 20*a,b* and resulting container 51*a,b* are described with more particularity below.

The blank 20*a,b* is cut, scored, perforated or otherwise formed to include a plurality of panels which, when assembled, create the container 54 of the present invention. Wherever possible the same number is used in related panels of the container 54. More specifically, in all FIGURES, like numbers indicate like parts. Additionally, cuts are shown as solid lines, score lines as dashed lines and lines of perforations as broken lines.

For the purpose of further description herein, the downward direction is defined as the direction perpendicular to bottom panel 22 that corresponds to the outer surface of the bottom panel when the container has been erected. The upward direction is defined as the direction perpendicular to the bottom panel 22 that corresponds to the inner surface of the bottom panel when the container has been erected.

Figure 1:
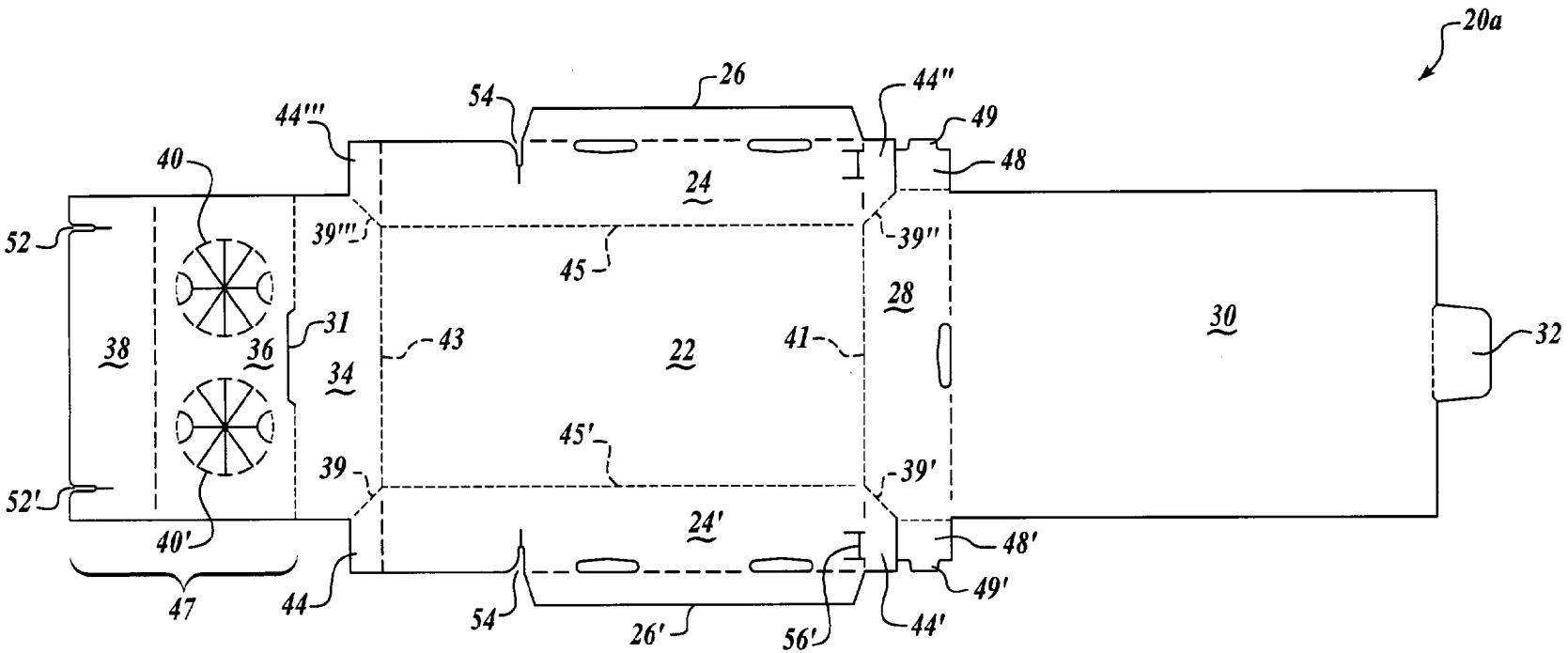
FIG. 1 is a plan view of a single piece container blank formed in accordance with the present invention.

Referring now to FIG. 1, the blank 20*a* includes a bottom panel 22. Attached to the bottom panel 22 along fold lines 45, 45' are opposed side panels 24, 24'. The side panels each include a side panel slot 54, 54'. A front panel 34 is attached to the bottom panel 22 along fold line 43. Also, a back panel 28 is attached to the bottom panel 22, opposite the front panel 34, along fold line 41. A top panel 30 is attached to the back panel 28 opposite the bottom panel 22. The top panel includes a top tab 32 opposite the back panel 28.

Interposed between the top panel 30 and the bottom panel 22, at opposite ends of the back panel 28 are locking panels 48, 48'. Each locking panel 48, 48' includes a locking tab 49, 49' positioned opposite the back panel 28. Each locking tab 49, 49' is configured to interact with locking slots 56, 56' formed in the side panels 24, and 24' when the blank 20*a* is formed into a container 51*a*.

With reference to FIG. 1, interposed between the various side panels 24, 24', back panel 28, and front panel 34, and in connection with the bottom panel 22 are corner panels 44, 44', 44", 44'". Comer fold lines 39, 39', 39", 39'" serve to attach the relative panels together. Typically, the corner fold lines 39, 39', 39", 39'" attach the relative panels together by a bellow fold or other type scored fold.

Side flaps 26, 26' are attached to the side panels 24, 24' opposite the bottom panel 22. The side flaps 26, 26' extend in length from about the attachment of the back panel 28 with the bottom panel 22 to about the side panel slots 54, 54'.

A unique aspect of the present invention is the nature of the attachment of the various side panels 24, 24', back panel 28, and front panel 34 and corner panels 44, 44', 44", 44'" to the bottom panel 22. Fold lines 41, 43, 45, 45' and corner fold lines 39, 39', 39", 39'" are score lines, and not lines of perforation or cut lines. The fold lines 41, 43 and 45, 45' and corner fold lines 39, 39', 39", 39'" do not have any open passage way between the relative panels. In this fashion, the container 51*a,b* is sift and leak proof when formed. By sift proof it is meant that the container 51*a,b* does not allow granular element to pass though the bottom panel 22 and surrounding panels. By leak proof it is meant, that the container 51*a,b* does not allow a liquid element to pass though the bottom panel 22 and surrounding panels.

A fold over divider panel assembly 47 is attached to the front panel 34, opposite the bottom panel 22. The fold over divider panel assembly 47 includes a cup panel 36 and a divider panel 38. Positioned between the front panel 38 and the cup panel 36 is a locking slot 31. The locking slot is size to accommodate the top tab 31.

The cup panel 36 includes at least one cup receptacle 40, 40' formed therethrough. The cup receptacle 40, 40' is preferably includes a "starfish" or other shaped cut elements configured to allow the insertion of a container (not shown) into the cup receptacle 40, 40'. The relative size of the cups 40, 40' is variable and will be dependent upon the size of the item to be place in the cup receptacle 40, 40'.

The divider panel 38 is attached to the cup panel 36 opposite the front panel 34. The divider panel 38 further includes at least a pair of divider panel slots 52, 52'. The divider panel slots 52, 52' like the side panel slots 54, 54' may include beveled entry guides to ease assembly of the container 51*a,b*.

Figure 2:
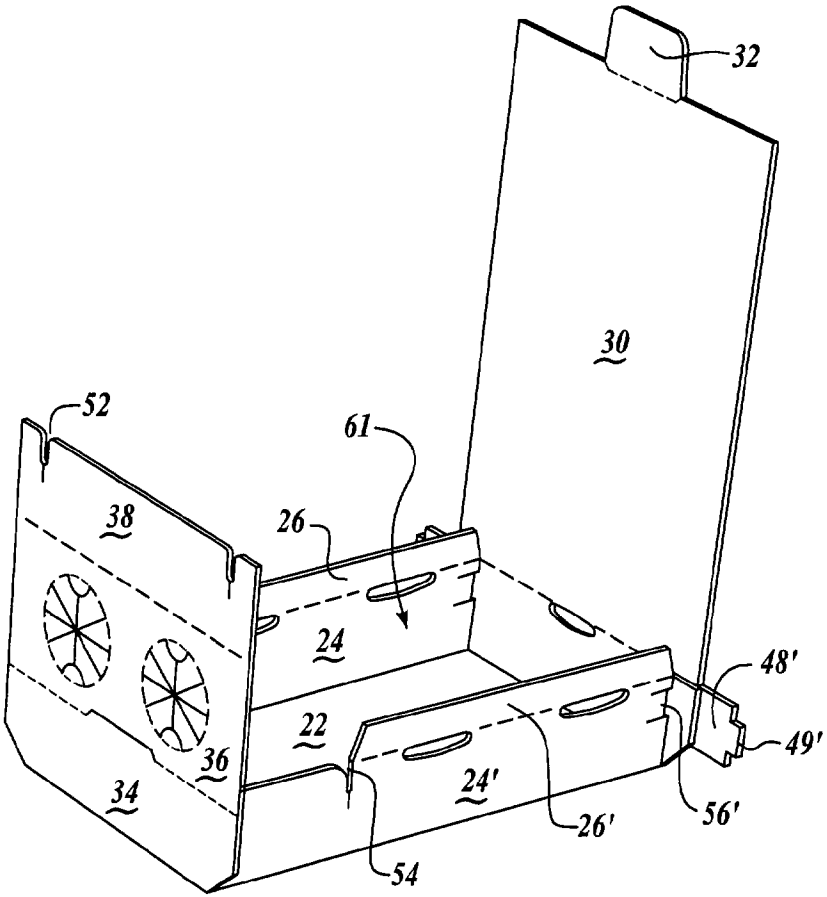
FIG. 2 is a perspective view of a partially assembled container according to the present invention.
Figure 3:
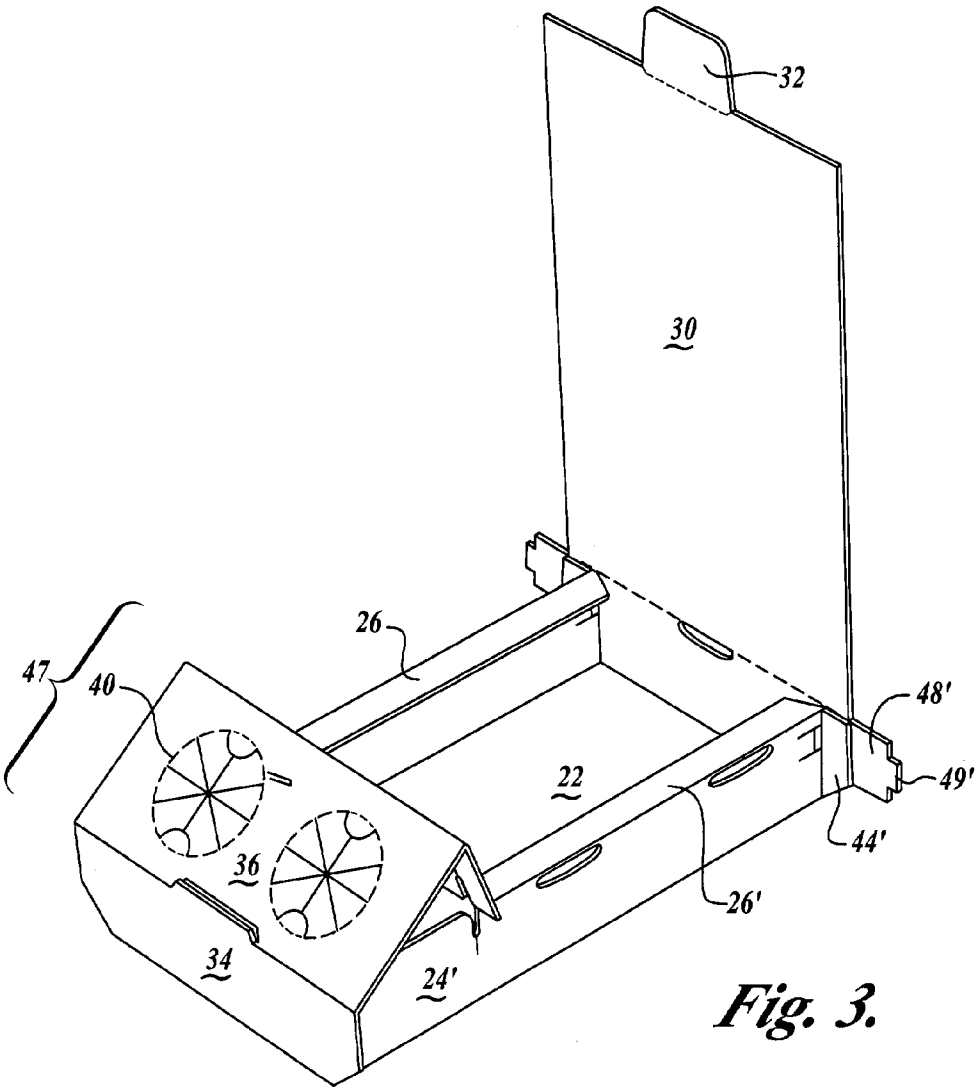
FIG. 3 is another perspective view of a partially assembled container according to the present invention.

FIGS. 2-5 illustrate the erection of the container 51*a* from the blank 20*a*. Initially the back panel 28, front panel 34 and side panels 24, 24' are folded upwards around fold lines 41, 43, 45, 45' respectively. In folding the blank 20*a* in this manner, a first container volume 61 is created. As best seen in FIG. 2, the side flaps 26, 26' are folded inward to provide a base of support for the top panel 30.

The fold over divider panel assembly 47 is folded inwardly such that the cup panel 36 is substantially parallel to the bottom panel 22 and the divider panel slots 52, 52' engage the side panel slots 54, 54'. When the respective divider panel slots 52, 52' and side panel slots 54, 54' are fully engaged the divider panel 38 is substantially perpendicular to the bottom panel 22. The engagement of the divider panel 38 with the respective side panels 24, 24' helps secure the container 51*a* in a stable position. The locking panels 48 provide additional support for the container 51*a* when they are folded to allow the locking tabs 49, 49' to engage the locking slots 56, 56'.

Figure 5:
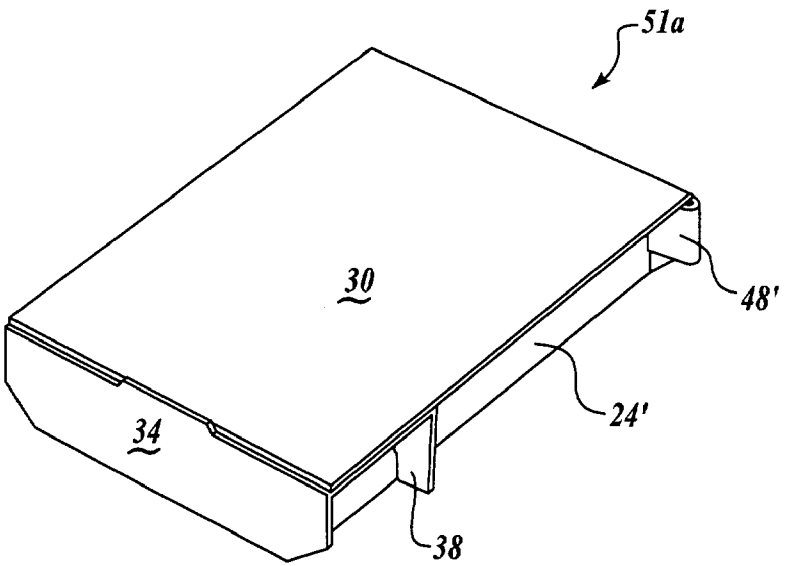
FIG. 5 is a perspective view of an assembled container according to the present invention.
Figure 4:
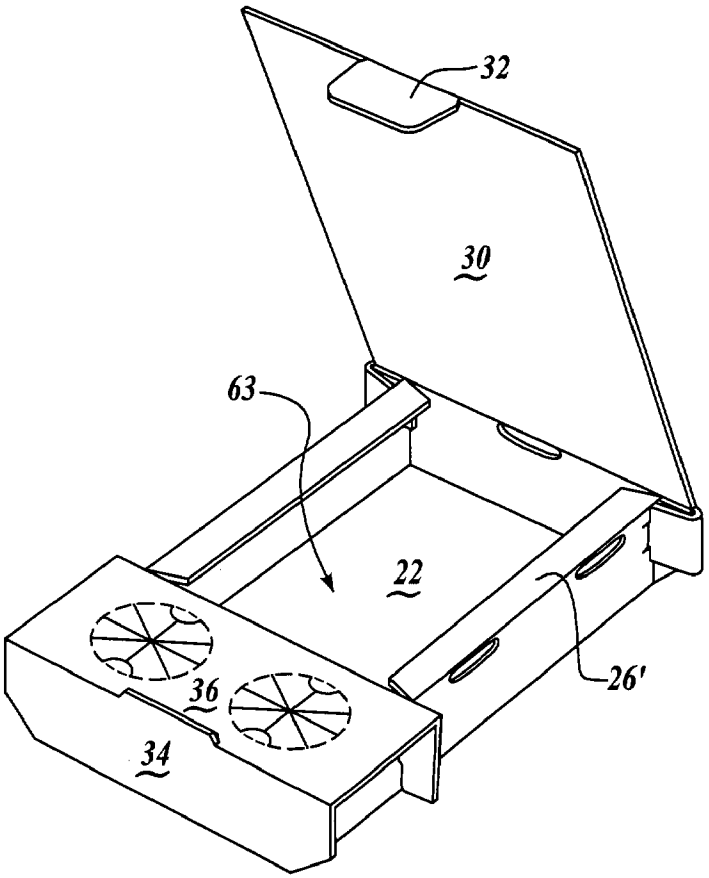
FIG. 4 is yet another perspective view of a partially assembled container according to the present invention.
Figure 6:
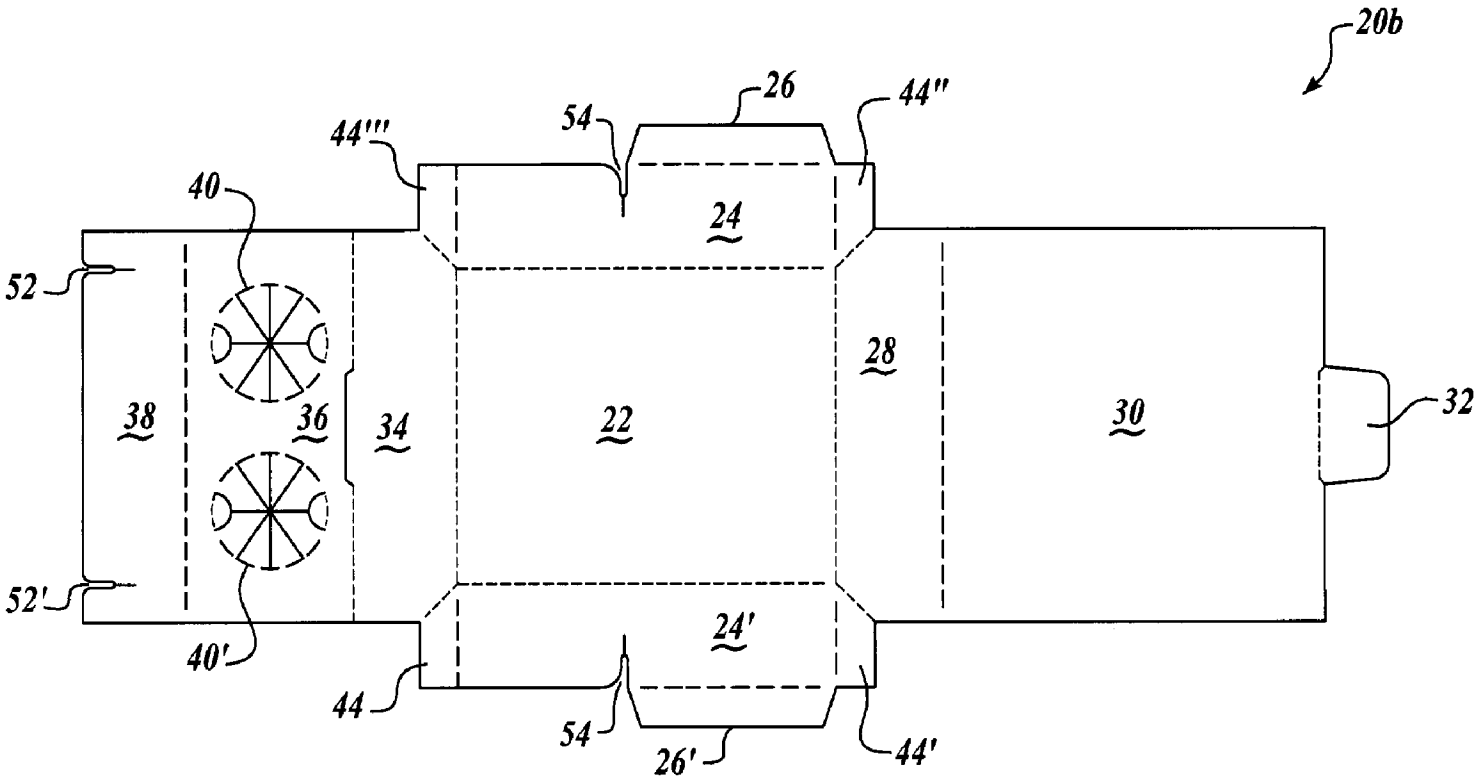
FIG. 6 is a plan view of a single piece container blank formed in accordance with another aspect of the present invention.
Figure 7:
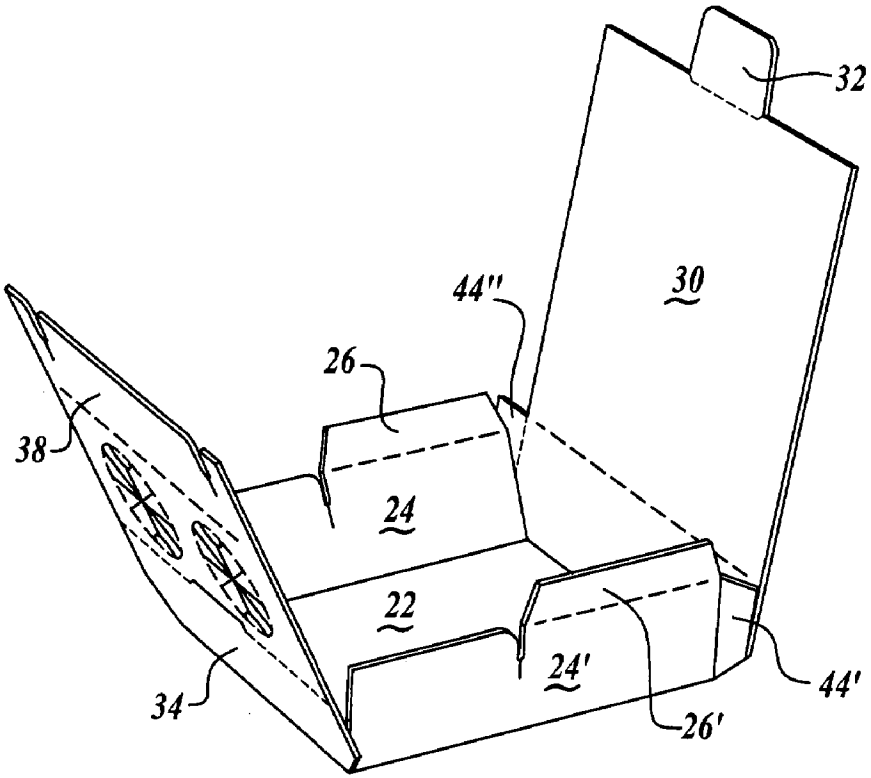
FIG. 7 is a perspective view of a partially assembled container according to the present invention depicted in FIG. 6.
Figure 9:
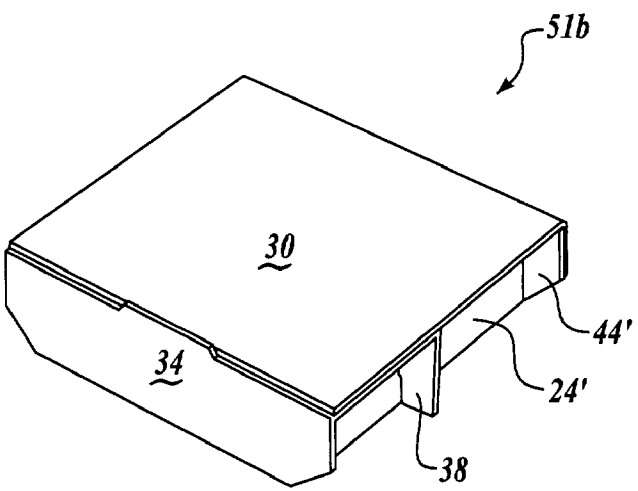
Figure 8:
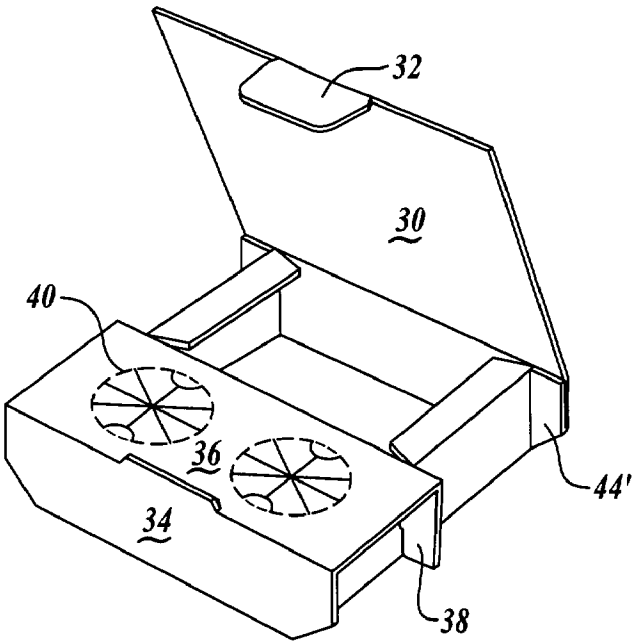
FIG. 8 is another perspective view of a partially assembled container according to the present invention depicted in FIG. 6; and, FIG. 9 is a perspective view of an assembled container according to the present invention depicted in FIG. 6.

As best seen in FIGS. 4 and 5, the assembled fold over divider panel assembly 47 creates a second container volume 63 and a stable, horizontal cup panel 36. The top panel 30 may then be folded to cover the other panels. The top tab 32 may be inserted into the top panel slot 50 to lock the container 51*a*. The top panel 30 is configured to completely cover the second container volume 63 and the fold over divider panel assembly 47. In this manner, the top panel serves as a sanitary barrier for products contained within the container. Further, the top panel 30 serves to secure any objects placed with the cups 40, 40' or second container volume.

FIGS. 6–9 depicts an additional aspect of the present invention. More specifically, the blank 20*b* and container 51*b* is configured without the locking panel 48, corner tab 49, 49' and locking slots 56, 56' of FIGS. 1–5. All other features of this aspect of the invention are otherwise the same as those discussed above. Those skilled the art will appreciate the structure and operation of this aspect of the invention without a detailed discussion herein.

The present invention may be used in a variety of manners. By way of non-limiting example, the container 51*a,b* may be used in the food industry. In an application items such as chicken wings or nuggets, dipping breads, French fries, or onion rings may be placed in the second container volume 63, while sauce containers (not shown) may be stored in the cups 40, 40'. By way of further non-limiting example, the present invention is suitable for use in the arts and crafts industry. In this manner, brushes or figurines (not shown) or the like may be held in the second container volume 63 while, paints (not shown) or other such items are supported in the cups 40, 40'. Those skilled in the art will appreciate that the present invention is suitable for many other uses as well.

Any variety of additional elements may be included, such as, without limitation, vents, specialized liners or grease barriers, etc., without departing from the spirit and scope of the present invention. Similarly, rounding or otherwise trimming the various panels is considered within the scope of the instant invention.

The blanks 20*a,b* and containers 51*a,b* shown in FIGS. 1–9 are made from any suitable material used in shipping. By way of non-limiting example, the present invention may be constructed from containerboard, paperboard, fiberboard, corrugated containerboard, plastics or combinations thereof. Further, any other material may be used to create the present invention.

While the preferred embodiment of the invention has been illustrated and described, as noted above, many changes can be made without departing from the spirit and scope of the invention. Accordingly, the scope of the invention is not limited by the disclosure of the preferred embodiment. Instead, the invention should be determined entirely by reference to the claims that follow.

What is claimed is:

1. A single sheet of foldable material cut and scored to define a container blank comprising:

a bottom panel, a front panel, a back panel, opposed side panels and a plurality of corner panels;

a top panel attached to said back panel opposite said bottom panel;

a fold over divider panel assembly having a cup panel attached to said front panel opposite said bottom panel and a divider panel attached to said cup panel, opposite said front panel;

a cup receptacle formed in said cup panel;

a divider panel slot formed in said divider panel opposite said cup panel;

a side panel slot formed in each of said side panels opposite said bottom panel;

wherein said front panel, said back panel and said opposed side panels are hingedly attached to said bottom panel via unperforated score lines.

2. The blank of claim 1, further comprising a side panel flap attached to said side panel, opposite said bottom panel.

3. The blank of claim 2, wherein said side panel flap extends substantially the distance of the side panel measured from the back panel to the side panel slots.

4. The blank of claim 1, further comprising a locking panel attached to said back panel.

5. The blank of claim 1, wherein the blank is constructed from at least one of a containerboard, paperboard, fiberboard, corrugated containerboard, plastics or combinations thereof.

6. A container comprising:

opposed bottom and top panels;

opposed front and back panels;

opposed side panels;

a side panel slot formed in each of said side panels opposite said bottom panel;

a fold over divider assembly including:

a cup panel attached to said front panel;

a cup receptacle formed in said cup panel;

a divider panel attached to said cup panel opposite said front panel; and at least two divider panel slots formed in said divider panel opposite said cup panel, wherein said divider panel lies in a plane substantially parallel to said front panel and intersects said side panels at said side panel slots such that said divider panel slot and said side panel slots interact.

7. The container of claim 6, further comprising a side flap attached to each of said side panels opposite said bottom panel.

8. The container of claim 6, wherein said top panel is sized to completely cover the container.

9. The container of claim 8, further comprising a top tab configured to lock said top panel to the fold over divider assembly.

10. The container of claim 6, wherein the container is constructed from at least one of a containerboard, paperboard, fiberboard, corrugated containerboard, plastics or combinations thereof.

* * * * *